United States Patent [19]

Liu

[11] Patent Number: 4,808,781

[45] Date of Patent: Feb. 28, 1989

[54] DIRECTLY DRIVEN MICROWAVE OVEN TURNTABLE TOP

[76] Inventor: Yiu-Ching Liu, 973 Shulman Ave., Santa Clara, Calif. 95050

[21] Appl. No.: 169,747

[22] Filed: Mar. 16, 1988

[51] Int. Cl.[4] ..... H05B 6/78

[52] U.S. Cl. ..... 219/10.55 F; 219/10.55 E; 108/20; 99/443 R

[58] Field of Search ..... 219/10.55 F, 10.55 E; 126/338; 108/20, 139; 99/443 R

[56] References Cited

U.S. PATENT DOCUMENTS

| | | | |
|---|---|---|---|
| 4,036,151 | 7/1977 | Shin | 108/20 |
| 4,219,715 | 8/1980 | Mandle et al. | 219/10.55 F |
| 4,501,945 | 2/1985 | Arabori et al. | 219/10.55 F |
| 4,523,070 | 6/1985 | Jorgensen et al. | 219/10.55 F |
| 4,590,351 | 5/1986 | Pomroy et al. | 219/10.55 F |
| 4,591,682 | 5/1986 | Takeuji | 219/10.55 F |
| 4,631,379 | 12/1986 | Aoyama | 219/10.55 F |
| 4,694,132 | 9/1987 | Liu | 219/10.55 F |
| 4,746,781 | 5/1988 | Dalquist III. et al. | 219/10.55 F |

*Primary Examiner*—Philip H. Leung

*Attorney, Agent, or Firm*—Thomas Schneck

[57] ABSTRACT

A portable microwave oven turntable having a base assembly defining a base interior. The base assembly includes a planar bottom and upwardly extending sides supporting a circular base cover member. Within the base interior is a spring motor which may be wound to rotate a drive shaft about a vertical axis. An upper portion of the drive shaft projects from the base interior through the base cover member. Atop the base cover member a drive gear is fixed to the upper portion of the drive shaft. The drive gear has a plurality of radially extending arms having coplanar upper surfaces and opposed lateral edges. A circular tabletop is rested upon the radial arms of the drive gear and tabletop teeth or projections engage the lateral edges of the radial arms. The tabletop projections extend downwardly from the lower surface of the tabletop and project radially inwardly from an annular hub. Rotation of the tabletop is translated directly from the drive shaft via the radial arms. A gear train governs the rotational speed of the tabletop.

14 Claims, 4 Drawing Sheets

DIRECTLY DRIVEN MICROWAVE OVEN TURNTABLE TOP

DESCRIPTION

1. Technical Field

The present invention relates generally to microwave oven cooking and in particular to a portable turntable for rotating food cooking within a microwave oven.

2. Background Art

Microwaves injected into the interior of a microwave oven rebound about the walls and door of the interior. As a result, the microwaves sometimes interfere with one another to produce cold spots or strengthen one another to produce hot spots. These cold spots and hot spots vary depending upon the cookware inserted into the microwave oven.

Over a period of years advances have been made in eliminating this nonuniformity of microwave oven distribution. However, some nonuniformity still exists and, as a result, many microwave cook booklets suggest the desirability of stopping the oven periodically and physically rotating the food.

U.S Pat. Nos. 4,036,151 to Shin and 4,591,682 to Takeuji disclose microwave ovens having a built-in turntable to effect uniform heating. Many conventional microwave ovens, however, do not include turntables. Therefore, to eliminate the inconvenience of manually rotating food, a need exists for a portable turntable that can be purchased as an accessory for a conventional microwave oven.

Portable turntables are known. For example, U.S. Pat. No. 4,694,132 to Liu discloses a portable microwave oven turntable that includes a removable tabletop driven at various points at or near its circumference. The removable tabletop permits easy inspection and cleaning of certain internal workings.

In the design of portable microwave oven turntables, two continuously important factors are compactness and ease of construction. Compactness is an important consideration since the cooking area of a particular microwave oven has a given volume which must be shared by the turntable and the foodstuff to be heated. A turntable having a high profile limits the dimensions of the foodstuff or the cookware to be used in conjunction with the turntable.

Ease of construction is an important factor since economic disadvantages of a turntable must be passed on to eventual users at the time of purchase. Thus, it is advantageous to reduce working parts to a minimum and to utilize necessary components in the most cost-efficient manner.

It is an object of the present invention to provide a microwave oven turntable which is compact and which promotes cost-efficiency by simplifying construction. It is another object to provide such a microwave oven turntable having a removable tabletop to facilitate inspection and cleaning.

DISCLOSURE OF THE INVENTION

The above objects have been met by a portable microwave oven turntable that includes a removable table top rotated directly by a drive gear. The drive gear is powered by a central shaft that is rotatably mounted within a base interior, but the drive gear is situated exterior of a base. Thus, the volume defined by the base of a microwave oven turntable can be substantially reduced to decrease the overall height of the turntable.

The turntable includes a base having a flat bottom and an upwardly extending cylindrical sidewall. A central drive shaft is rotatably attached to the base bottom to form a vertical axis of rotation. A spring having a first end secured to the base and having a second end fixed to the drive shaft provides rotational drive to the drive shaft. The upper extent of the drive shaft projects through a central aperture in a circular cover mounted to the base. Also within the volume defined by the base and cover is a gear train having a governor to insure a relatively constant rotational speed of the drive shaft.

A circular base cover is connected to the base and the upper portion of the drive shaft extends through a center aperture of the base cover. The drive gear is positioned atop said base cover and is axially fixed to the upper portion of the central drive shaft. The drive gear includes a plurality of upwardly prominent arms which extend radially outward. The arms have coplanar upper surfaces and opposed lateral edges. A circular tabletop rests upon the radial arms. Projections, such as teeth, on the lower surface of the tabletop releasably engage the lateral edges of the radial arms for rotation therewith. The tabletop has a downwardly protruding annular hub coaxial the central drive shaft and the projections extend radially inward from the hub.

An advantage of the present invention is that the need for separate assemblies to transfer rotational drive from the central drive shaft to workings within the base interior and then to workings exterior of the base is eliminated. Instead, a single drive gear operates both the interior workings, e.g. the governor, and the exterior workings, e.g. the tabletop. This translates into a savings of both space and cost of production. A related advantage is that because fewer parts are involved, less mass must be driven. Consequently, a larger mass of foodstuff may be accommodated.

BEST MODE FOR CARRYING OUT THE INVENTION

Figure 1:
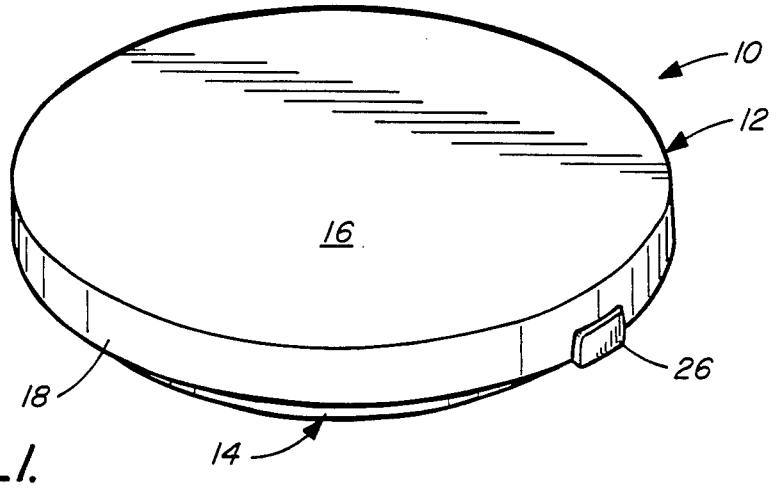
FIG. 1 is a top perspective view of a turntable in accord with the present invention.
Figure 2:
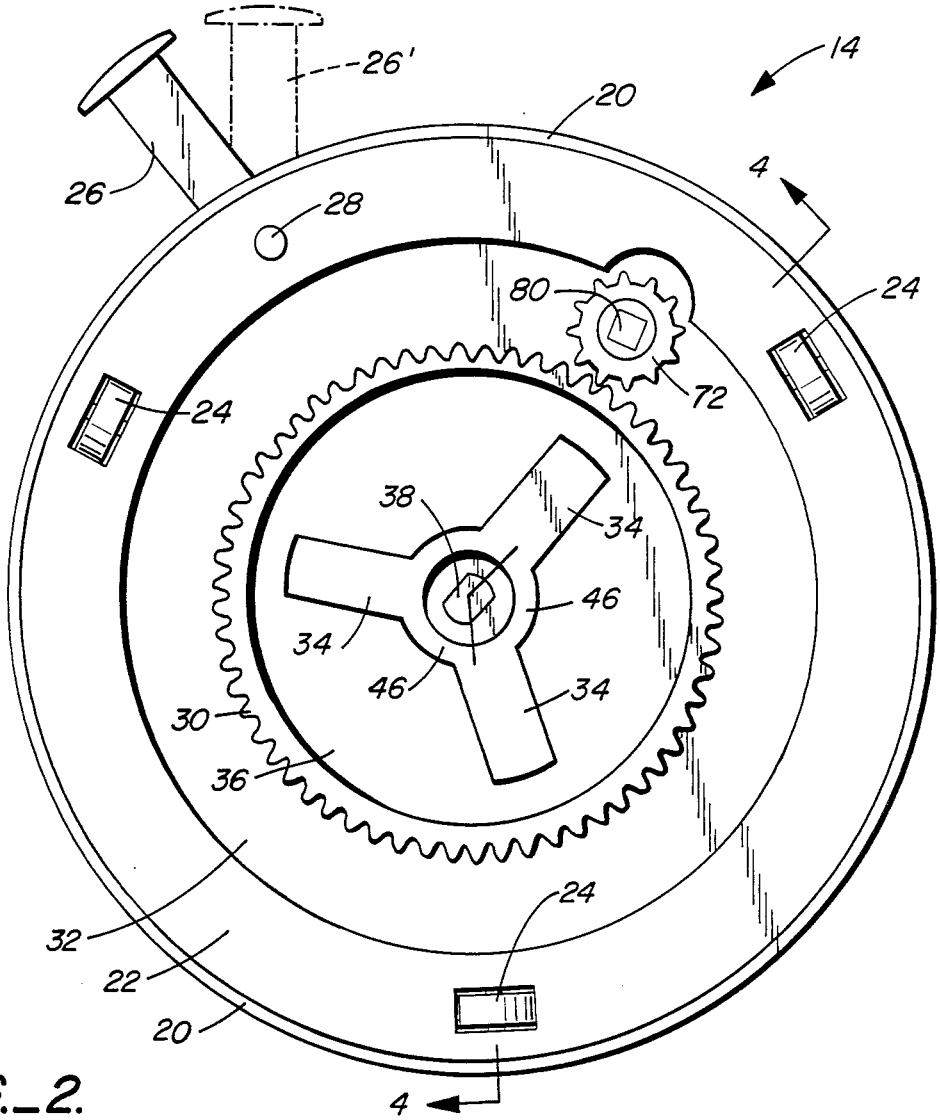
FIG. 2 is a top view of the base assembly of FIG. 1.

With reference to FIGS. 1 and 2, a turntable 10 has a tabletop 12 in a base assembly 14. The tabletop 12 includes a circular platform 16 and a cylindrical side wall 18 depending from the circular platform. The tabletop is made of a low-loss plastic material which is generally transparent to microwaves.

The base assembly 14 has an upwardly extending cylindrical side wall 20. A base cover member 22 is supported atop the base assembly by the sidewall 20. Three freely rotating wheels 24 are fixed to the base cover member 22 such that the upper portion of the wheels extend above the surface of the base cover member. A brake arm 26 is pivotally attached to the base assembly at a pivot pin 28. As will be explained more fully below with reference to FIGS. 5 and 5A, the brake arm may be pivoted to preclude rotation of the tabletop 12. The brake arm 26 is shown in a locked position, while brake arm 26' is in a release position.

A drive gear 30 is mounted concentric to the base cover member 22. To minimize the height of the base assembly 14, the drive gear 30 is positioned within a recessed area 32 of the base cover member 22. Integral the drive gear 30 are a plurality of radial arms 34 within a recessed area 36 of the drive gear. Although the radial arms 34 are within a recessed area, the radial arms extend above the base cover member further than the remainder of the drive gear. The drive gear is fixed to a central drive shaft 38 projecting through the base cover member. The drive gear is snugly fit to the central drive shaft such that rotation of the drive shaft is translated to the drive gear.

Figure 3:
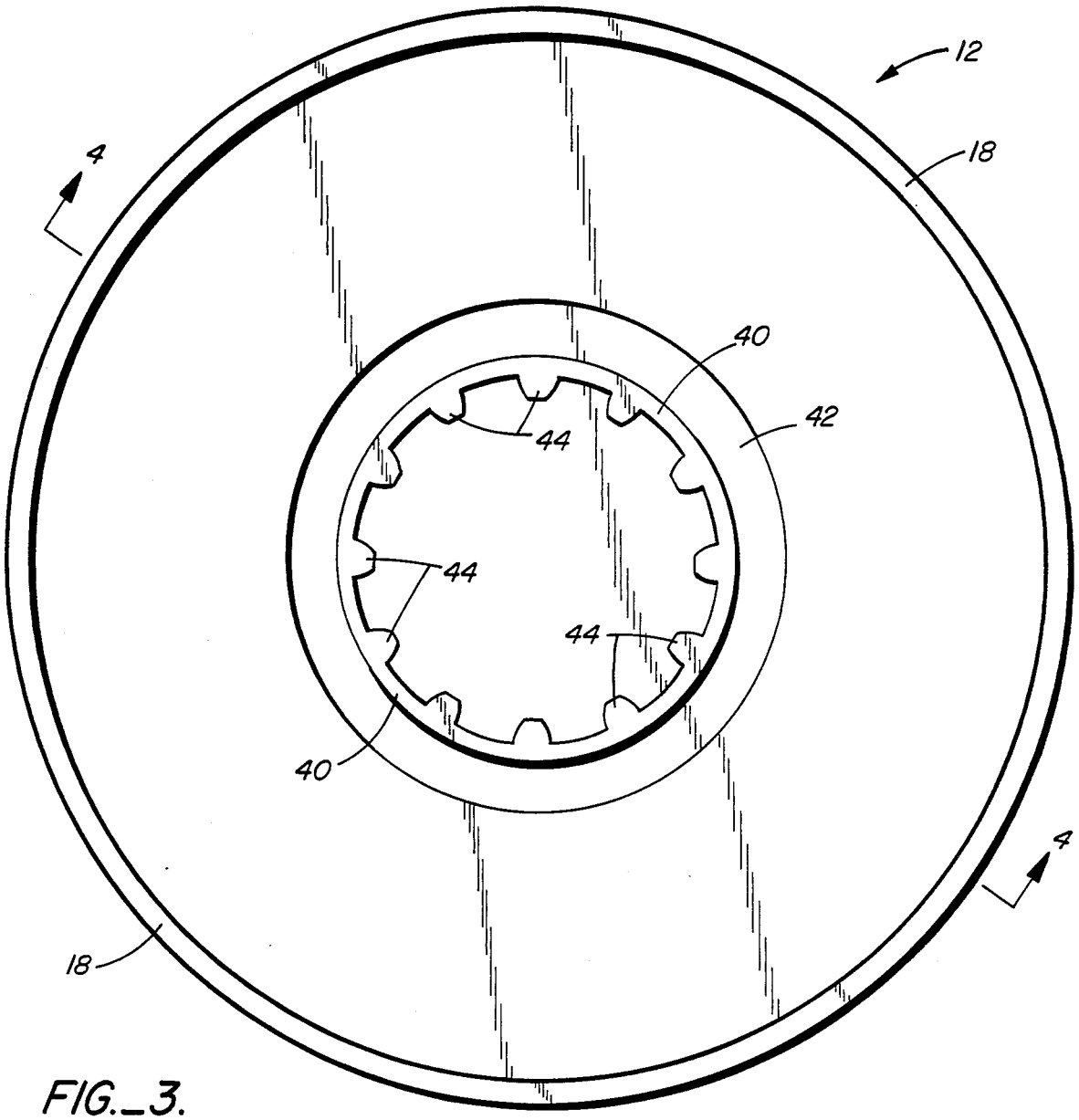
FIG. 3 is a bottom view of the tabletop of FIG. 1.
Figure 4:
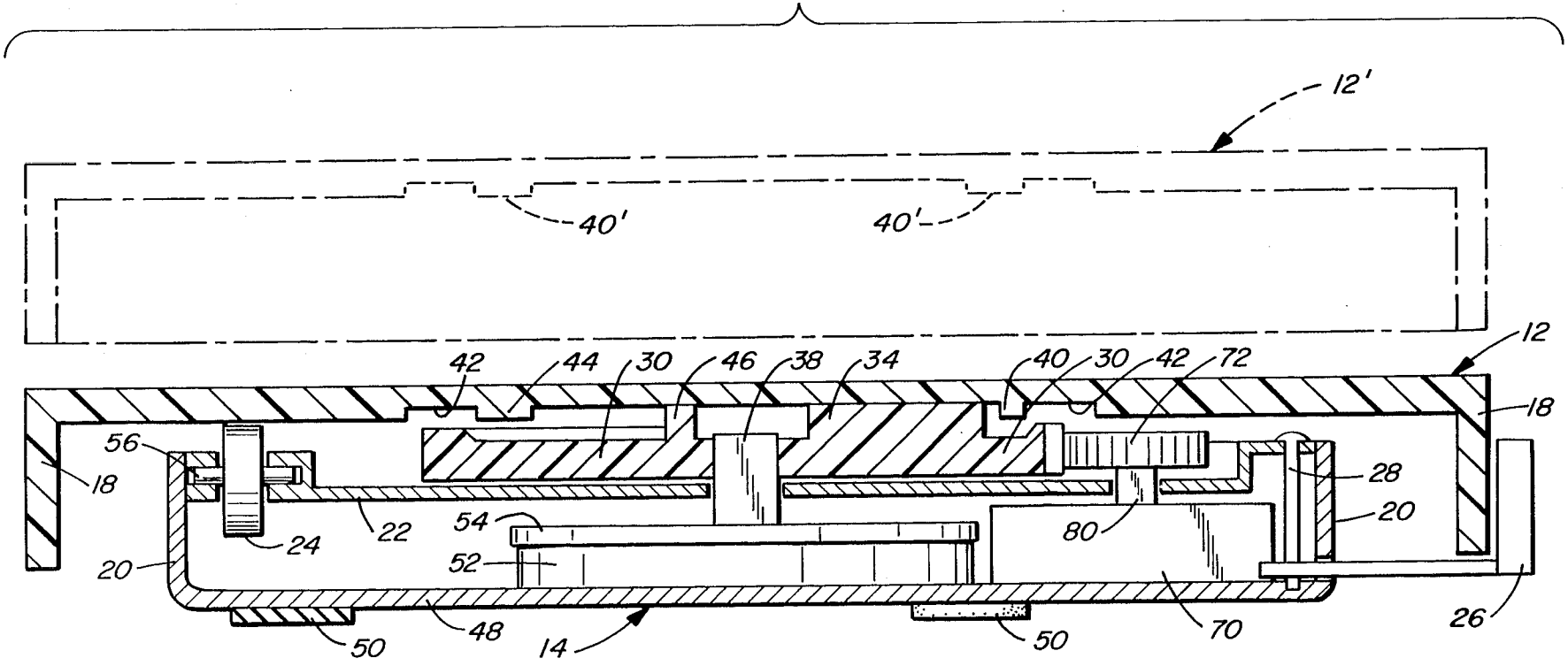
FIG. 4 is a side sectional view taken along lines 4—4 of FIGS. 3 and 4.

Referring now to FIGS. 3 and 4, the downwardly depending cylindrical side wall 18 of the tabletop 12 has a diameter exceeding the diameter of the base assembly 14. The tabletop will therefore extend over the base assembly. Radially inward of the cylindrical side wall 18 is an annular hub 40. The annular hub is fit within a relief 42 in the surface of the tabletop adjoining the base assembly. A plurality of projections 44, such as teeth, extend downwardly from the tabletop 12 and radially inwardly from the hub 40.

The tabletop may be removed from the base assembly 14 by lifting, as shown in 12' of FIG. 4. When brought into contact with the base assembly 14, the mass of the tabletop 12 is supported at specific areas. Firstly, the tabletop 12 is in frictional contact with the freely rotating wheels 24. FIG. 2 illustrates the wheels 24 as being spaced apart by 120° to insure an even distribution of weight. The tabletop secondly contacts an annular region 46 from which the radial arms 34 radially project. Lastly, the mass of the tabletop is supported on the three rollers 24 in FIG. 2. Referring to FIGS. 2–4, the radially outermost ends of the arms 34 contact the projections 44 of the tabletop 12. The lateral edges of the projections 44 contact the lateral edges of the radial arms 34. Thus, rotation of the radial arms 34 causes rotation of the tabletop 12.

The rotational drive for the radial arms 34 is provided from within the base assembly 14. The base assembly includes a circular, horizontal plate 48 which rests upon a plurality of feet 50. A motor housing 52 is attached to the circular base plate 48. Within the motor housing 52 is a stud, not shown, which projects upwardly from the base plate 48. The central drive shaft 38 is rotatably fitted over the stud. A coil spring, not shown, has a first end fixed to the motor housing 52 and a second end fixed to the central drive shaft 38. When the coiled spring is tightly wound, the drive shaft will be urged to rotate about a vertical axis passing through the drive shaft. A motor housing cover 54 shields the coil spring from microwaves.

The central drive shaft 38 has an upper portion extending through the base cover member 22. As may be seen in FIG. 2, the uppermost portion of the drive shaft 38 has opposed parallel sides which match the configuration of a central aperture in the drive gear 30. Thus, when the drive shaft 38 is caused to rotate by the coil spring or by other motor means, the drive gear 30 and the radial arms 34 rotate as well. As noted above, rotation of the radial arms 34 is translated to the tabletop 12 via the frictional contact of lateral edges of the radial arms with the lateral edges of projections 44. Rotation of tabletop 12 is facilitated by the freely rotating wheels 24 which are mounted on axles 56 trapped by the base cover member 22.

Figure 5:
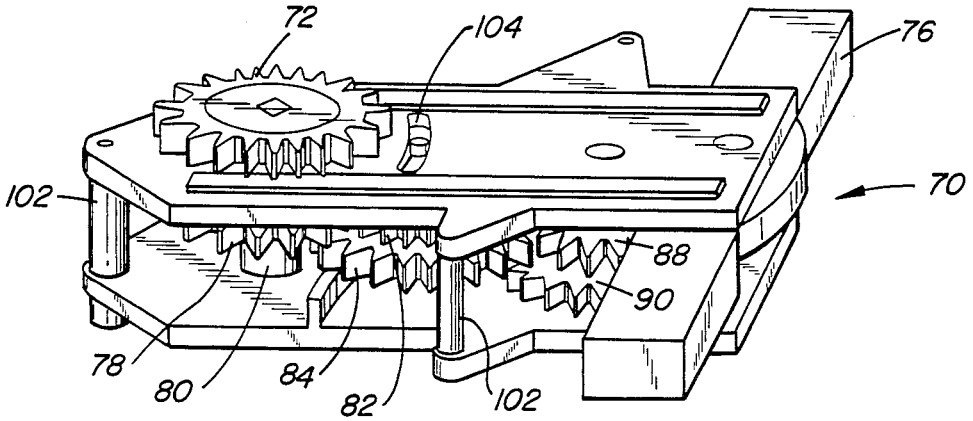
FIG. 5 is a perspective view of the gear train within the apparatus of FIG. 4.
Figure 5A:
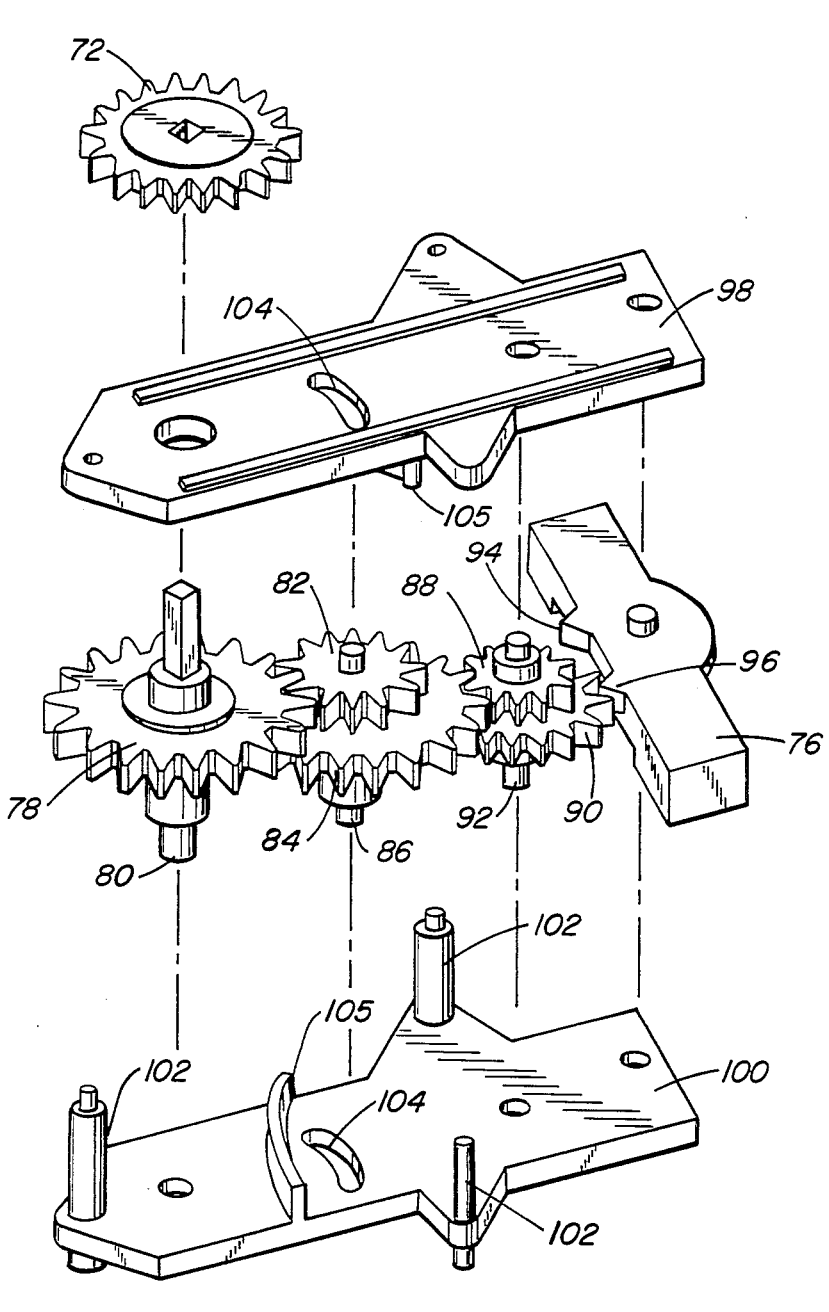
FIG. 5A is an exploded view of the gear train of FIG. 5.

The coil within motor housing 52 receives potential energy by clockwise rotation of the drive gear 30. However, a coil spring which is tightly wound will unwind quickly when released unless a mechanism governs the speed of the unwinding action. That is, unless a mechanism is provided to govern the speed at which the coil spring unwinds, the tabletop 12 will spin out of control when the coil spring is wound and then released. Referring to FIGS. 4, 5 and 5A, the tabletop is prevented from uncontrollably spinning by a gear train assembly 70. The gear train assembly includes an input gear 72 having teeth in meshing engagement with the drive gear 30. Since the drive gear is coaxially fixed to the drive shaft 38, the drive shaft will rotate only as quickly as the gear train assembly permits.

The gear train assembly 70 is a gear step-up transmission mechanism. A governor 76 ultimately determines the rate of input gear rotation. In a gear step-up transmission the rotational speed of an input gear is multiplied at each succeeding gear. The input gear 72 is mounted coaxially with an escapement gear 78 on shaft 80. Shaft 80 extends through the base cover member 22, permitting the input gear to be fixed outside of the base interior. The escapement gear meshes with an idler gear 82 that is coaxial with an intermediate gear 84 on shaft 86. The intermediate gear then meshes with an idler gear 88 that is coaxial with a ratchet gear on shaft 92.

The governor 76 has two pawls 94 and 96 meshing with the ratchet gear 90 at different points. A first pawl 94 will completely mesh with a tooth on the ratchet gear only when the second pawl 96 is freed from the ratchet gear. The second pawl will completely mesh only when the first pawl 94 is freed from the ratchet gear. Thus, the governor 76 will oscillate back and forth as the ratchet gear 90 rotates and the permissible speed of gear rotation is determined by the vibrational speed of the governor 76. Shafts 80, 86 and 92 are held between a pair of plates 98 and 100. The plates are spaced apart by posts 102. Plates 98 and 100 each have an elongated slot 104 through which shaft 86 is slidably fit. When the input gear 72 is caused to be rotated in a counterclockwise direction, the escapement gear 78 forces the shaft 86 to one end of the slot 104. In this position the intermediate gear 84 meshes with the ratchet gear 90. If, however, the input gear is rotated in a clockwise direction, as when the coil spring is being wound, the shaft 86 is forced to the opposite end of the slot 104 whereupon the intermediate gear 84 will not mesh with the ratchet gear. This construction prevents the governor 76 from impeding the speed at which the coil spring can be wound. Ridges 105 insure that the movable idler gear 82 remains in the same plane as the escapement gear 78.

The brake arm 26 is provided for locking the governor 76. In this manner, the tabletop 12 may be prevented from rotating until rotation is desired. A pivot pin 28 penetrates the base cover member 22 and is received in the horizontal base plate 48. The brake arm 26 is pivotally mounted to the pivot pin 28. When rotated in a locked position, the brake arm 26 contacts the governor 76 to preclude movement of the governor and rotation of the tabletop 12. In a release position the brake arm is moved away from the governor and rotation of the tabletop follows.

Referring to all of the figures in general but FIG. 4 in particular, energy for tabletop rotation is stored by twisting of the tabletop 12 with respect to the base 14. Upon release of the tabletop, the drive shaft 38 is urged to rotate. The drive shaft and the drive gear 30 begin to rotate but the rotational speed is controlled by oscillations of the governor 76, which is part of the gear train 70. A braking mechanism is provided to prevent rotation.

Movement of the central drive shaft 38 is transmitted to the drive gear 30 which supports the mass of the tabletop 12. Frictional contact between the lateral edges of the radial arms 34 and those of the tabletop projections 44 cause the tabletop to rotate.

While the preferred embodiment contains teeth on the hub 40 of the tabletop, it is understood that other projections may be utilized as an alternative. For example, pins projecting downwardly from the tabletop so as to abut the radial arms 34, may be employed to transfer rotational motion to the tabletop.

The force required to wind the microwave oven turntable is less than 5 lbs. of torque. The turntable is able to operate with a load in excess of 10 lbs. The rate of rotation is about 1 revolution per minute and revolution will occur for approximately 20 minutes, but these factors may be varied by varying the gear ratios of the gear train 70.

I claim:

1. A portable microwave oven turntable comprising, a base having a horizontal bottom and upwardly extending sides to form a base interior, a motor means disposed within said base interior, a central drive shaft attached to said base to form a vertical axis of rotation, said motor means disposed to turn said drive shaft, a means for governing the rotational speed of said central drive shaft, a circular base cover member connected to said upwardly extending sides of the base, said base cover member combining with the bottom and sides of the base to form said base interior into a sustantially enclosed volume, as said base cover member having an inner circumference defining a central aperture, as id central drive shaft having an upper portion projecting through said central aperture in proximity to said inner circumference, a drive gear position atop said base cover member, said drive gear axially fixed to said upper portion of the central drive shaft, said drive gear having an upper surface having a plurality of upwardly prominent arms, each arm spaced apart from adjacent arms, and a circular tabletop rested atop said arms of said drive gear in a freely removable manner, said tabletop having a substantially planar platform and a plurality of projections extending downwardly from a surface of said tabletop adjoining the arms, a plurality of said projections in rotational transfer engagement with said arms.

2. The microwave oven turntable of claim 1 wherein said arms each extend radially outward with respect to said drive gear and wherein said arms have coplanar upper surfaces.

3. The microwave oven turntable of claim 2 wherein said projections are disposed to form a hub coaxial said central drive shaft, a plurality of said projections extending vertically along a lateral surface of an arm and radially inward along said surface of the tabletop adjoining said arms.

4. The microwave oven turntable of claim 1 wherein said circular tabletop has a vertical cylindrical side wall.

5. The microwave oven turntable of claim 1 wherein said means for governing rotational speed includes a gear train having an oscillating governor and having an input gear in meshing relation with said drive gear.

6. The microwave oven turntable of claim 1 further comprising a braking mechanism for preventing rotation of said drive shaft.

7. A portable microwave oven turntable comprising, a base assembly having a planar bottom and upwardly extending base sides and having a circular base cover member attached to said base sides to form an enclosed base cavity, said base assembly further having a drive shaft rotatable about a vertical axis and having a motor means for rotating said drive shaft, said motor means disposed within said base cavity, said drive shaft having a portion projecting through the center of said circular base cover member from said base cavity, a drive gear attached to said portion of the drive shaft projecting through said circular base cover member for rotation therewith, said drive gear having a plurality of radial arms having coplanar upper surfaces and opposed lateral surfaces, and a circular tabletop positioned above said drive gear in a freely removable manner, said tabletop having a plurality of teeth releasably engaging said lateral edges of the radial arms for rotation therewith, said table top having a downwardly protruding annular hub coaxial with said central drive shaft, said teeth extending radially inwardly from said hub.

8. The microwave oven turntable of claim 7 further comprising a gear train means for governing the speed of rotation of the drive shaft.

9. The microwave oven turntable of claim 8 further comprising a braking mechanism, said braking mechanism selectively locking operation of said gear train means, thereby preventing drive shaft rotation.

10. The microwave oven turntable of claim 7 further comprising a plurality of freely rotating rollers fixed to said base cover member and in frictional contact with said circular tabletop.

11. The microwave oven turntable of claim 8 wherein said gear train means includes an input gear atop said base assembly and in meshing engagement with said drive gear, the gear train means further includes a plurality of gears disposed within said base cavity.

12. The microwave oven turntable of claim 7 wherein said drive gear and said radial arms are an integral member.

13. The microwave oven turntable of claim 7 wherein said circular tabletop includes a downwardly depending cylindrical sidewall.

14. The microwave oven turntable of claim 7 wherein said base cover member has a central recessed area and said drive gear is disposed within said recessed area.

* * * * *